US006568372B1

(12) United States Patent
Kanno

(10) Patent No.: US 6,568,372 B1
(45) Date of Patent: May 27, 2003

(54) CONTROL SYSTEM FOR OUTBOARD MOTOR

(75) Inventor: Isao Kanno, Shizuoka (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 09/517,927

(22) Filed: Mar. 3, 2000

(30) Foreign Application Priority Data

Mar. 4, 1999 (JP) ..... 11-057642
Mar. 31, 1999 (JP) ..... 11-093359

(51) Int. Cl.[7] ..... F02D 41/06
(52) U.S. Cl. ..... 123/491
(58) Field of Search ..... 123/491, 195 P

(56) References Cited

U.S. PATENT DOCUMENTS 4,131,098 A 12/1978 Daniels et al. ..... 123/406.13
4,515,131 A 5/1985 Suzuki et al. ..... 123/491
4,656,993 A 4/1987 Yuzawa et al. ..... 123/643
4,987,871 A * 1/1991 Nishikawa ..... 123/491
4,998,521 A 3/1991 Inoue et al. ..... 123/406.12
5,073,133 A 12/1991 Inoue ..... 440/1
5,088,465 A * 2/1992 DeBiasi et al. ..... 123/491
5,535,135 A * 7/1996 Bush et al. ..... 702/24
5,713,334 A 2/1998 Anamoto ..... 123/491
5,870,986 A * 2/1999 Ichinose ..... 123/491
5,878,726 A * 3/1999 Takahashi et al. ..... 123/195 P

* cited by examiner

*Primary Examiner*—Andrew M. Dolinar
(74) *Attorney, Agent, or Firm*—Knobbe, Martens, Olson & Bear, LLP.

(57) ABSTRACT

A fuel injection system for an internal combustion engine includes an improved control device for quickly starting the engine. The internal combustion engine includes at least one combustion chamber formed by at least a first member and a second member that moves relative to the first member. The second member is coupled to an output shaft such that movement of the second member causes the output shaft to rotate. A fuel injector supplies fuel to the combustion chamber. The fuel injector includes an actuator to regulate an amount of fuel injected by the fuel injector. The internal combustion engine further includes a fuel control system that comprises a controller, which is connected to the fuel injector actuator, and a sensor, which is arranged to detect rotation of the output shaft. The sensor is adapted to produce a signal that is indicative of rotation of the output shaft and is connected to the controller. The controller is configured to output a control signal to actuate the fuel injector actuator when a signal is received from the sensor indicating that the output shaft has initially begun to rotate.

26 Claims, 6 Drawing Sheets

CONTROL SYSTEM FOR OUTBOARD MOTOR

PRIORITY INFORMATION

This application is based on and claims priority to Japanese Patent Application No. 11-057642 filed Mar. 4, 1999 and Japanese Patent Application No. 11-093359 filed Mar. 31, 1999. The entire contents of these applications are hereby expressly incorporated by reference.

BACKGROUND OF THE INVENTION

1. Field of the Invention

This invention relates to a fuel injection control system for an engine, and more particularly to a fuel injection control system that is suitable for an outboard motor.

2. Description of Related Art

In order to improve engine performance and in particular fuel efficiency and emissions, many types of engines use a fuel injection system for supplying fuel to the engine. A fuel injection system often includes fuel injectors that directly inject fuel into an air induction device. The amount of fuel injected through the fuel injectors is determined by a control system, which usually includes an electronic control unit (ECU). Typically, the ECU determines the desired amount of fuel and the corresponding fuel/air ratio based upon the engine speed and load. The fuel injection system can therefore improve performance by precisely controlling the fuel/air ratio for each cycle of the engine and over a wide variety of engine running conditions.

There are, however, several problems with typical fuel injection systems. For example, when the engine is being started, engine speed cannot be determined until the engine completes one or more revolutions. Accordingly, fuel is not delivered to the fuel injectors immediately. This prevents the engine from operating immediately and requires the starter device to turn the engine longer. The problem is exacerbated if the engine speed is determined by measuring the rotation of the camshafts because the camshafts are often rotated at half the speed of the crankshaft.

Furthermore, when the engine is being started, the fuel/air ratio usually needs to be rich. To achieve this result, some engines include a starter signal device. The starter signal device generates a signal that indicates when the engine is being started. This signal is inputted into the ECU of the control system. When the signal indicates that the engine is being started, the ECU delivers the proper amount of fuel such that the fuel/air mixture is rich. The starter signal device adds an additional engine component to the engine. This increases the size of the engine and manufacturing costs. Additionally, the ECU must include an additional connector to receive the signal from the starter device. The additional connector increases the size and cost of the ECU.

Fuel injection systems are often used in outboard motors. Because outboard motors are often operated under harsh conditions, it often is desirable that they start quickly. Furthermore, it is well known in the art that outboard motors should be as compact as possible. Accordingly, it is especially important that outboard motor components be as small as possible and that the arrangement of outboard motor be as compact as possible.

SUMMARY OF THE INVENTION

Accordingly, there is a need for a for an improved fuel injection control system that enables the engine to start more quickly. There is also a need for a simplified control system that uses a fewer number of parts.

In accordance with one aspect of the present invention, an internal combustion engine comprises at least one combustion chamber formed by at least a first member and a second member that moves relative to the first member. The second member is coupled to an output shaft such that movement of the second member causes the output shaft to rotate. A fuel injector supplies fuel to the combustion chamber. The fuel injector includes an actuator to regulate an amount of fuel injected by the fuel injector. The internal combustion engine further includes a fuel control system that comprises a controller, which is connected to the fuel injector actuator, and a sensor, which is arranged to detect rotation of the output shaft. The sensor is adapted to produce a signal that is indicative of rotation of the output shaft and is connected to the controller. The controller is configured to output a control signal to actuate the fuel injector actuator when a signal is received from the sensor indicating that the output shaft has initially begun to rotate.

In accordance with another aspect of the present invention, an internal combustion engine comprises at least one combustion chamber that is formed by at least a first member and a second member that moves relative to the first member. The second member is coupled to an output shaft such that movement of the second member causes the output shaft to rotate. A fuel injector supplies fuel to the combustion chamber. The engine further includes a controlling means for starting the injection of fuel into the combustion chamber after the output shaft begins rotating as the engine is started.

In accordance with a further aspect of the present invention, an internal combustion engine comprises at least one combustion chamber formed by at least a first member and a second member that moves relative to the first member. The second member is coupled to an output shaft such that movement of the second member causes the output shaft to rotate. A fuel injector supplies fuel to the combustion chamber. The fuel injector includes an actuator to regulate an amount of fuel injected by the fuel injector. The engine further includes a fuel control system that comprises a controller, which is connected to the fuel injector actuator, and a sensor, which is arranged to detect rotation of the output shaft. The sensor is adapted to produce a signal that is indicative of rotation of the output shaft and is connected to the controller. The controller is configured to operate under an engine start routine when starting the engine and to determine when an engine reaches an engine start speed, which is indicative of the engine having started, so as to operate under a normal operation routine.

In accordance with still a further aspect, a method of starting an internal is provided. The combustion engine includes at least one a combustion chamber, a crankshaft, at least one camshaft, and at least one fuel injector. The method comprises sensing the rotation of either the crankshaft or the camshaft, determining an amount of fuel to be injected by the fuel injector toward the combustion chamber, and injecting the amount of fuel into the combustion chamber in response to the sensed rotation of either the crankshaft or the camshaft when the respective shaft initially begins to rotate as the engine is starting.

Further aspects, features and advantages of this invention will become apparent from the detailed description of the preferred embodiment which follows.

BRIEF DESCRIPTION OF THE DRAWINGS

The above-mentioned and other features of the invention will now be described with reference to the drawings of the preferred embodiments of the present fuel injection controls system. The illustrated embodiment of the fuel injection control system is intended to illustrated but not to limit the invention. The drawings contain the following figures.

DETAILED DESCRIPTION OF PREFERRED EMBODIMENTS OF THE INVENTION

Figure 1:
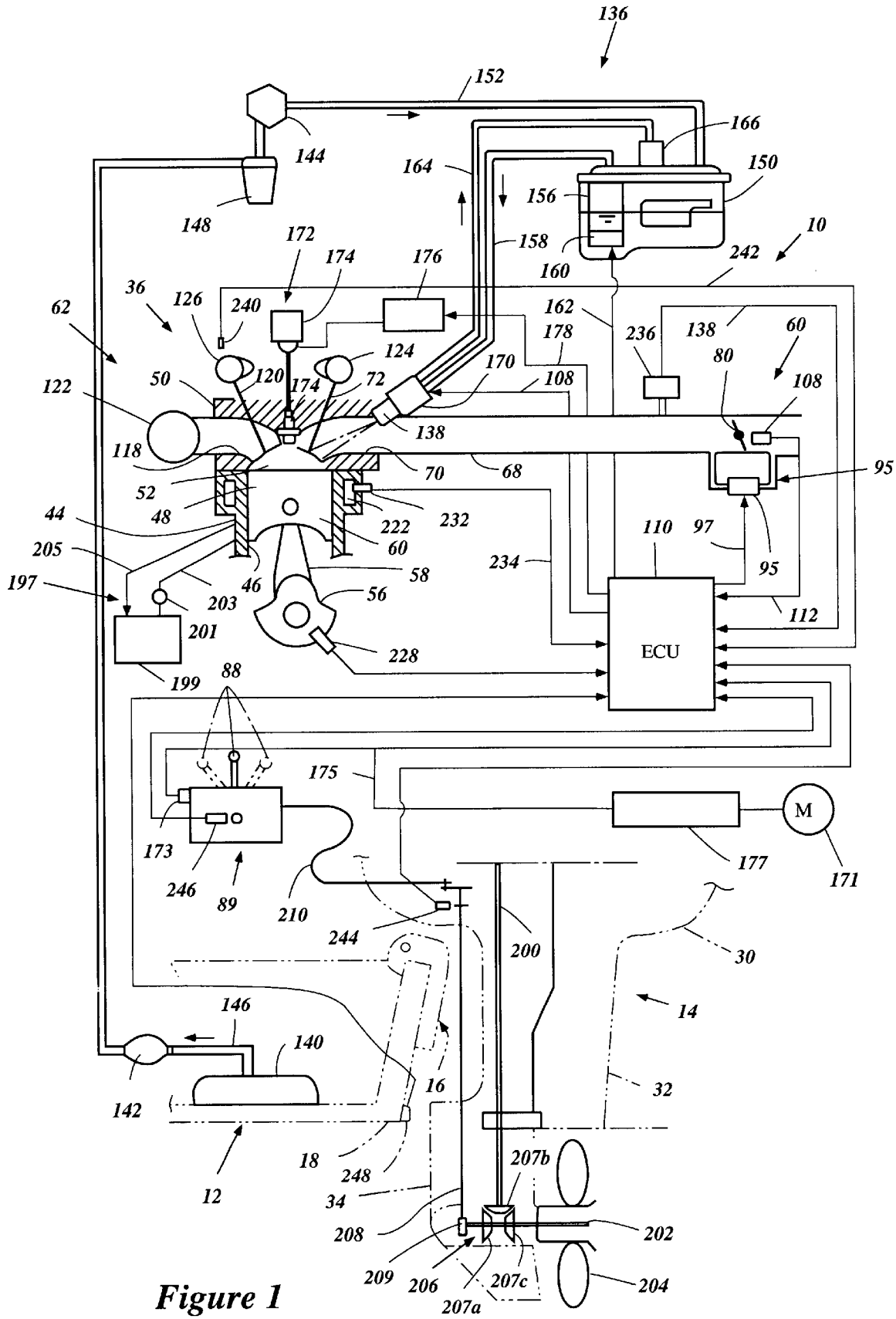
FIG. 1 is a schematic view showing an outboard motor in accordance with an embodiment of the present invention. An engine, in part, and an ECU are shown generally in the upper half of the figure. The outboard motor, in part, with a transmission, a shift device of the transmission and an associated watercraft are shown in the lower half of the figure. The ECU and a fuel supply line link the two views together. The outboard motor and associated watercraft are illustrated in phantom.
Figure 2:
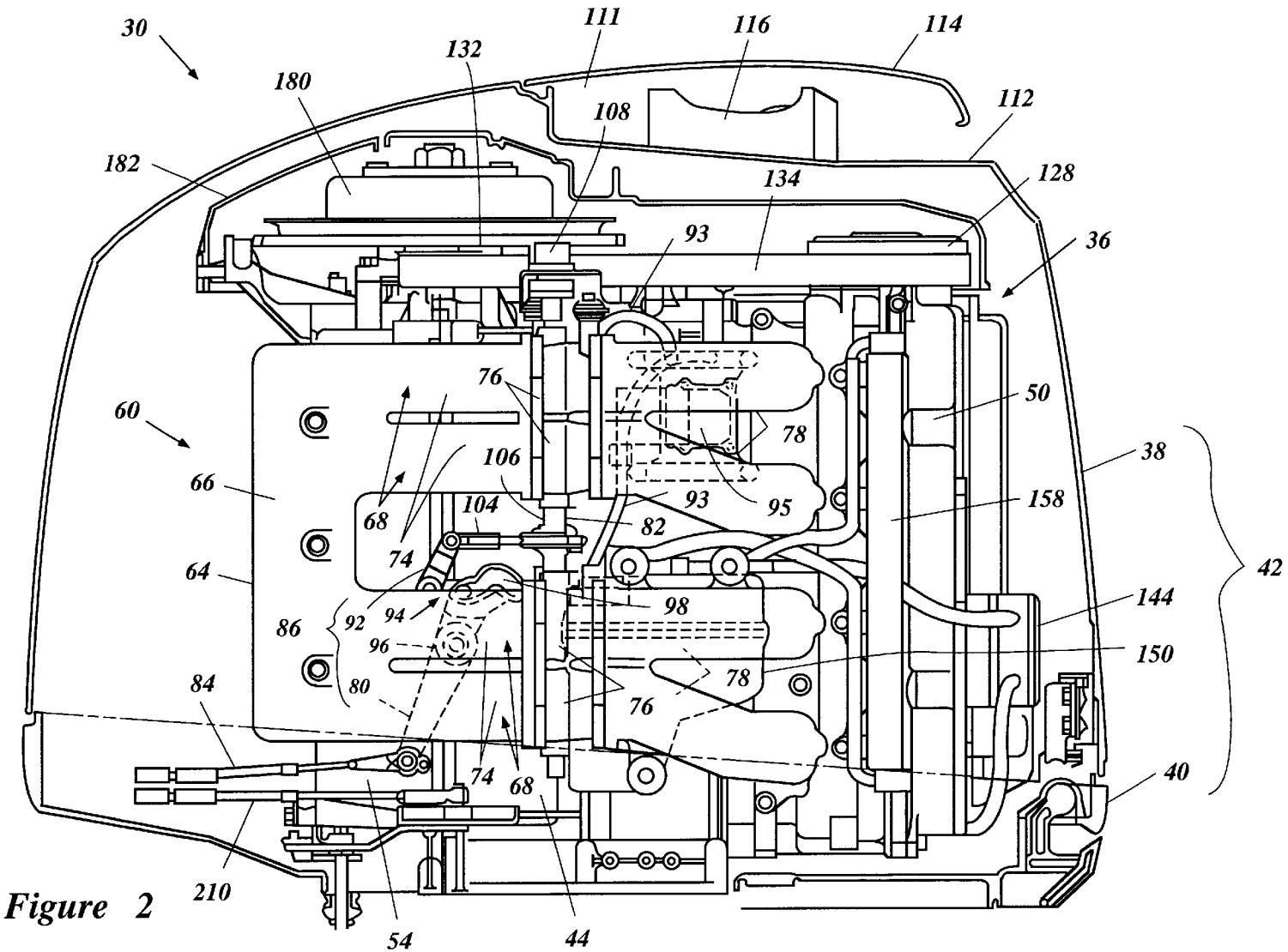
FIG. 2 is an elevational side view of the powerhead of the outboard motor shown in FIG. 1. An upper and a lower protective cowling are shown in section.
Figure 3:
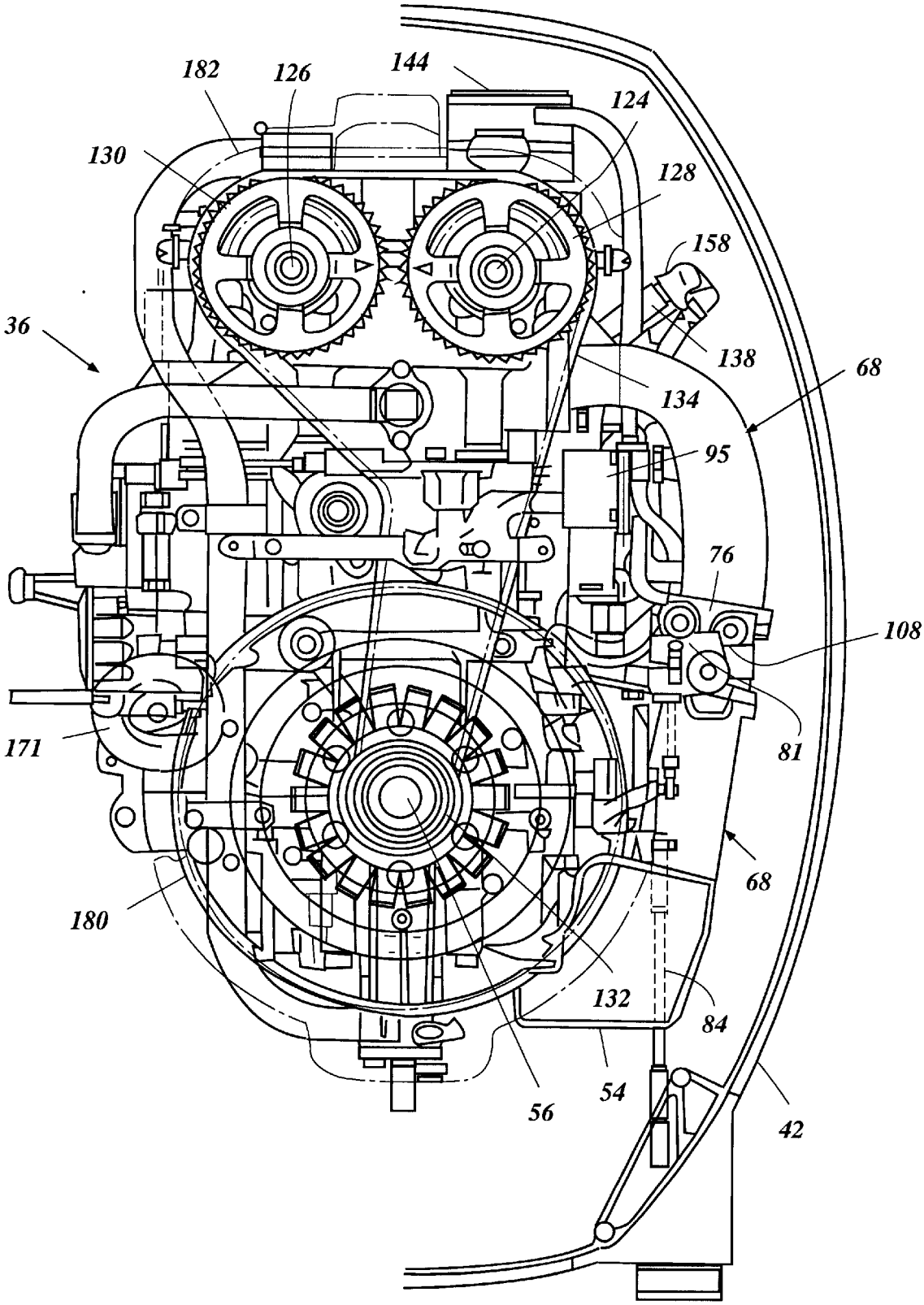
FIG. 3 is a top plan view of the engine shown in FIG. 2. The upper protective cowling is detached and one half of the lower cowling is omitted.

With initial reference to FIGS. 1 to 3, an outboard motor 10 for powering a watercraft 12 is illustrated. The outboard motor 30 advantageously has a fuel injection control system arranged and configured in accordance with certain features, aspects, and advantages of the present invention. The fuel injection control system of the present invention may also find utility in other applications that require the engine to start quickly, or to be compact, or both. Such applications might include, without limitation, personal watercraft, small jet boats, and offroad vehicles.

With reference to FIG. 1, the outboard motor 10 in the illustrated embodiment comprises a drive unit 14 and a bracket assembly 16. Although schematically shown in FIG. 1, the bracket assembly 16 comprises a swivel bracket and a clamping bracket. The swivel bracket supports the drive unit 14 for pivotal movement about a generally vertically extending steering axis. The clamping bracket, in turn, is affixed to a transom 18 of the watercraft 12 and supports the swivel bracket for pivotal movement about a generally horizontally extending axis. A hydraulic tilt system can be provided between the swivel bracket and clamping bracket to tilt up or down the drive unit 14. If this tilt system is not provided, the operator may tilt the drive unit 14 manually. Since the construction of the bracket assembly 16 is well known in the art, a further description is not believed to be necessary to enable those skilled in the art to practice the invention.

As used throughout this description, the terms "forward," "front" and "fore" mean at or to the side of the bracket assembly 16, and the terms "rear," "reverse" and "rearwardly" mean at or to the opposite side of the front side, unless indicated otherwise.

With reference to FIGS. 1–2, the drive unit 14 will now be described in detail. The drive unit 14 includes a drive shaft housing 32, and a lower unit 34. A power head 30 is disposed atop the drive unit 14 and includes an engine 36, a top protective cowling 38 and a bottom protecting cowling 40. The cowlings 38, 40, define a cowling assembly 42.

The engine 36 operates on a four stroke combustion principle and powers a propulsion device. As seen in FIG. 1, the engine 36 has a cylinder block 44. In the illustrated embodiment, the cylinder block 44 defines four cylinder bores 46, in which a corresponding number of pistons 48 reciprocate. The cylinder bores 46 extend generally horizontally and are spaced generally vertically from each other. As such, the engine 36 is an L4 (in-line 4 cylinder) type. However, it is to be noted that the engine 36 may be of any type (e.g., v-type, opposed), may have other numbers of cylinders and/or may operate under other principles of operation (e.g., two-cycle, rotary, or diesel principles).

A cylinder head assembly 50 is affixed to one end of the cylinder block 44 and defines four combustion chambers 52 with the pistons 48 and the cylinder bores 46. The other end of the cylinder block 44 is closed with a crankcase member 54 (FIG. 2); which defines a crankcase chamber.

With continued reference to FIGS. 1 and 2, a crankshaft 56 extends generally vertically through the crankcase chamber. The crankshaft 56 is connected to the pistons 48 by connecting rods 58 and rotates with the reciprocal movement of the pistons 48 within the cylinder bores 46. The crankcase member 54 is located at the forward most position of the power head 30, and the cylinder block 44 and the cylinder head assembly 50 extend rearwardly from the crankcase member 54.

The engine 36 includes an air induction system 60 and an exhaust system 62. The air induction system 60 is configured to supply air charges to the combustion chambers 52. The induction system 60 includes a plenum chamber member 64 (FIG. 2), which defines a plenum chamber 66 therein. Four main intake passages 68 extend from the plenum chamber 66 to a corresponding number of intake ports 70 formed on the cylinder head assembly 50.

The intake ports 70 are opened and closed by intake valves 72. When the intake ports 70 are opened, air from the intake passages 68 and intake ports 70 flows into the combustion chambers 52.

The plenum chamber member 64 is positioned on the port side of the crankcase member 54. The plenum chamber member 64 has an inlet opening (not shown) at its front side that opens to the interior of the cowling assembly 42. The plenum chamber member 64 functions as an intake silencer and/or a collector of air charges. The air intake passages 68 extend rearwardly from the plenum chamber 66 along the cylinder block 44 and curve toward the intake ports 70. The respective intake passages 68 are vertically spaced apart from each other.

With reference to FIG. 2, the air intake passages 68 are defined by duct sections 74, throttle bodies 76, and runners 78. The duct sections 74 are formed integrally with the plenum chamber member 64.

As shown in FIG. 2, the upper two throttle bodies 76 are integrated with each other. The upper two intake runners 78 are also integrated with each other at their fore portions and then forked into two portions. The lower two throttle bodies 76, as viewed in FIG. 2, and the corresponding lower two intake runners 78 have the same construction as the upper two throttle bodies 76 and intake runners 78, respectively.

The respective throttle bodies 76 support throttle valves 80 (FIG. 1) therein for pivotal movement about axes 81 (FIG. 3) of valve shafts extending generally vertically. The valve shafts are linked together to form a single valve shaft assembly 82 that passes through the throttle bodies 76.

The throttle valves 80 are operable via a throttle cable 84 (FIG. 2) and a non-linear control mechanism 86. The throttle cable 84 is connected to a throttle/shift lever 88 (FIG. 1) that is positioned within an operational control unit 89. The operational control unit 89 is positioned in the watercraft 12 so as to be operable by an operator of the watercraft 12.

With reference to FIG. 2, the non-linear control mechanism 86 includes a first lever 90 and a second lever 92 joined together with each other by a cam connection 94. The first lever 90 is pivotally connected to the throttle cable 84 and also to a first pin 96 which is affixed to the crankcase member 54. The first lever 90 has a cam hole 98 at the opposite end of the connection with the throttle cable 84. The second lever 92 is generally shaped as the letter "L" and pivotally connected to a second pin 100 which is affixed to the crankcase member 54. The second lever 92 has a pin 102 that reciprocates within the cam hole 98. The other end of the second lever 92 is connected to a control rod 104. The control rod 104, in turn, is pivotally connected to a lever member which is connected to the throttle valve shaft assembly 82 via a torsion spring 106 that urges the control rod 104 to the position shown in FIG. 2. At this position of the control rod 104, the throttle valve 80 is in a closed position wherein almost no air charge can pass through the air intake passages 68.

When the throttle cable 86 is operated by the throttle/shift lever 88, the first lever 90 pivots about the first pin 96 in a counter-clockwise direction, as viewed in FIG. 2. The second lever 92, then pivots about the second pin 100 in a clockwise direction. Since the cam follower pin 102 of the second lever 92 reciprocates in the cam hole 98, the second lever 92 moves according to the shape of the cam hole 98. Thus, the second lever 92 pushes the control rod 104 against the bias force of the torsion spring 106 to open the throttle valves 80. When the throttle cable 84 is released, the control rod 104 returns to the initial position by the biasing force of the spring 106 and the throttle valves 80 are closed again.

A throttle valve position sensor 108 is arranged atop of a throttle valve shaft assembly 82. The position sensor 108 sends a signal via a throttle position data line 112 to an ECU 110, which is mounted on the left side of the engine 36. The signal from the throttle valve position sensor 108 corresponds to throttle opening and the engine load. The position sensor 108 and the ECU 110 are preferably part of an engine control system which controls various aspects of engine operation and will be described in more detail below.

As shown in FIGS. 1 and 2, the illustrated air induction system 60 includes a bypass passage or idle air supply passage 93 that bypasses the throttle valves 80. An idle air adjusting unit 95, which includes a butterfly valve or another kind of valve therein, is provided in the bypass passage 93. As shown in FIG. 2, the idle air adjusting unit 95 is located between the cylinder block 44 and air intake passages 68. The valve in the idle air adjusting unit 95 is controlled by the ECU 110 through a signal line 97.

With reference to FIG. 2, the cowling assembly 42 generally completely encloses the engine 36. The upper cowling 38 is detachably affixed to the bottom cowling 40 so that an operator can access the engine 36 for maintenance or other purposes. The upper cowling 38 has an air intake compartment 111 defined between a top surface 112 of the upper cowling 38 and cover members 114. Each air intake compartment 111 has an air inlet duct 116 that connects the space in the compartment 111 and the interior of the cowling assembly 42.

In operation, air is introduced into the air intake compartments 111 and enters the interior of the cowling assembly 42 through the air inlet ducts 116. The air then passes through the inlet opening of the plenum chamber member 64 and enters the plenum chamber 66. During idle of the engine 36, an air charge amount is controlled by the throttle valves 80 to meet the requirements of the engine 36. The air charge then flows through the runners 78 and to the intake ports 72 (FIG. 2).

As described above, the intake valves 72 are provided at the intake ports 70. When the intake valves 72 are opened, the air is supplied to the combustion chambers 52 as an air charge. Under the idle running condition, the throttle valves 80 are generally closed. The air, therefore, enters the ports 70 through the idle air adjusting unit 95, which is controlled by the ECU 110. The idle air charge adjusted in the adjusting unit 95 is then supplied to the combustion chambers 52 via the intake ports 70.

The exhaust system 62 is configured to discharge burnt charges or exhaust gasses outside of the outboard motor 10 from the combustion chambers 52. Exhaust ports 118 are defined in the cylinder head assembly 50 and are opened and closed by exhaust valves 120. When the exhaust ports 118 are opened, the combustion chambers 52 communicate with a single or multiple exhaust passages 122 that lead the exhaust gasses downstream through the exhaust system 62.

An intake camshaft 124 and an exhaust camshaft 126 are provided to control the opening and closing of the intake valve 72 and exhaust valves 120, respectively. The camshafts 124, 126 extend approximately vertically and parallel with each other. The camshafts 124, 126 have cam lobes that act against the valve 72, 120, at predetermined timings to open and close the respective ports. The camshafts 124, 126 are journaled on the cylinder head assembly 50 and are driven by the crankshaft 56 via a camshaft drive unit. In the illustrated embodiment, the camshaft drive unit is positioned at the upper end of the engine 36, as viewed in FIG. 3.

With reference to FIG. 3, the camshaft drive unit includes sprockets 128, 130 mounted to an upper end of the camshafts 124, 126. The crankshaft 56 also includes a sprocket 132 at an upper end thereof A timing belt or chain 134 is wound around the sprockets 128, 130, 132. As the crankshaft 156 rotates, the cam shafts 124, 126 are thereby driven.

With reference to FIG. 1, the engine 36 also includes a fuel injection system 136. The fuel injection system 136 includes four fuel injectors 138 which have injection nozzles exposed to the intake ports 70 so that injected fuel is directed toward the combustion chambers 52. A main fuel supply tank 140 is part of the fuel injection system and is placed in the associated watercraft 12.

Fuel is drawn from the fuel tank 140 by a first low pressure pump 142 and a second low pressure pump 144 through a first fuel supply conduit 146. The first low pressure pump 142 is a manually-operated pump. The second low pressure pump 144 is a diaphragm-type pump operated by one of the intake and exhaust camshafts 124, 126. In the illustrated embodiment, the second low-pressure fuel pump 144 is mounted on the cylinder head assembly 50 (FIG. 2).

A quick disconnect coupling (not shown) is preferably provided in the first fuel conduit 146. A fuel filter 148 is positioned in the conduit 146 at an appropriate location.

From the low pressure pump 144, fuel is supplied to a vapor separator 150 through a second fuel supply conduit 152. In the illustrated embodiment, the vapor separator 150 is affixed to the lower two intake runners 78, as viewed in FIG. 2 and between the intake runner 78 and the cylinder block 44. At the vapor separator end of the conduit 152, a float valve is provided which is operated by a float 154 so as to maintain a uniform level of the fuel contained in the vapor separator 136.

A high pressure fuel pump 156 is provided within the vapor separator 136 and pressurizes fuel within the vapor separator 150. The high-pressure fuel pump 156 is connected with the fuel injectors 138 through a fuel delivery conduit 158. Preferably, the conduit 158 itself forms a fuel rail connecting the fuel injectors 158 with the high-pressure fuel pump 156. The high-pressure fuel pump 156 is driven by an electric motor 160 that is directly connected to the pump 156 at its lower end, as viewed in FIG. 1. The electric motor 160 is activated by the ECU 110 and is controlled via a fuel pump control line 162.

A fuel return conduit 164 is also provided between the fuel injectors 138 and the vapor separator 150. Excess fuel that is not injected by the injector 138 returns to the vapor separator 150 through the conduit 164. A pressure regulator 166 is mounted on the vapor separator 150 at the end of the return conduit 164 to limit the pressure of the fuel delivered to the fuel injectors 138. The flow generated by the return of unused fuel from the fuel injectors aids in cooling the fuel injectors.

In operation, a predetermined amount of fuel is sprayed into the intake ports 70 via the injection nozzles of the fuel injectors 138. The fuel charge delivered by the fuel injectors 138 enters the combustion chambers 52 with an air charge at the moment the intake valves 72 are opened. Since the fuel pressure is regulated by the pressure regulator 166, the amount of fuel injected into the combustion chamber 52 is determined in part by the duration in which the nozzles of the injectors 138 are opened. Preferably, the fuel injectors 138 are opened and closed by solenoids 170, as is known in the art. The solenoids 170 are controlled by the ECU 110, which is connected to the solenoids by a fuel injector control line 168. A fuel control system, which will be described in more detail below, directs the opening and closing of the fuel injectors.

As shown in FIG. 1, the engine 36 further includes an ignition system, indicated generally by the reference numeral 172. Four spark plugs 174 are fixed on the cylinder head assembly 50 and exposed into the respective combustion chambers 52. The spark plugs 174 ignite an air/fuel charge at a certain timing as determined by the ECU 110 to bum the air/fuel charge therein. For this purpose, the ignition system 172 includes an ignition coil 176 interposed between the spark plugs 174 and the ECU 110, along a spark plug control line 178.

As seen in FIGS. 2 and 3, a flywheel assembly 180 is affixed to an upper end of the crankshaft 56. A cover member 182 covers the flywheel assembly 180, sprockets 128, 130, 132, and the belt 134 so as to prevent debris and/or other foreign materials from becoming entrained in the sprockets 128, 130, 132 and to protect an operator from the moving components when the upper cowling 38 is removed. The flywheel assembly 180 includes an AC generator that generates electric power. The generated AC power is led to a battery (not shown), through a rectifier that rectifies the AC power to DC power. The battery accumulates electrical energy therein and also supplies it to electrical equipment including the ECU 110, solenoids 170, and ignition coil 176.

As shown in FIGS. 1 and 3, the outboard motor 10 preferably includes a starter motor 171 that drives the flywheel assembly 180 when starting the engine. The use of a starter motor is preferred when the present invention is employed with larger size engines. An operator activates the starter motor 171 by a starter switch 173 that is preferably located in the watercraft 12. The starter switch 173 is connected to the starter motor 173 by a signal line 175. The signal line 175 is also connected to the ECU 110. The illustrated embodiment also includes a drive circuit 177 that can be used to generate a larger current for the starter motor 171. While not illustrated, the engine 36 can also include a recoil starter to drive the flywheel assembly 180 in addition to or in the alternative to the starter motor 171.

As seen in the lower half of FIG. 1, the driveshaft housing 32 depends from the power head 30 and supports a driveshaft 200 that is driven by the crankshaft 56 of the engine 36. The driveshaft 200 extends generally vertically through the driveshaft housing 32. The driveshaft housing 32 also defines internal passages (not shown) which form portions of the exhaust system 62.

The lower unit 34 depends from the driveshaft housing 32 and supports a propulsion shaft 202 which is driven by the driveshaft 200. The propeller shaft 202 extends generally horizontally through the lower unit 34. In the illustrated embodiment, the outboard motor 10 includes a propeller 204 that is affixed to an outer end of the propeller shaft 202.

A transmission 206 is provided between the driveshaft 200 and the propeller shaft 202. The transmission 206 couples together the two shafts 200, 202 which lie generally normal to each other (i.e., at a 90° angle) with bevel gears 207*a*, 207*b*, 207*c*.

A switchover mechanism is provided for the transmission 206 to shift rotational directions of the propeller 204 between forward, neutral and reverse. The switchover mechanism includes a shift cam 209, a shift rod 208 and shift cable 210. The shift rod 208 extends generally vertically through the driveshaft housing 32 and the lower unit 34, while the shift cable 210 extends outwardly from the lower cowling 40 (see FIG. 2) and is connected to the throttle/shift lever 88 that is operable by the operator when the operator wants to shift the transmission directions.

The lower unit 34 also defines an internal passage that forms a discharge section of the exhaust system 62. At engine speed above idle, the majority of the exhaust gasses are discharged to the body of water surrounding the outboard motor 10 through the internal passage and finally through a hub of the propeller 204.

The engine 36 includes a lubrication system 197 that is shown schematically in FIG. 1. The lubrication system lubricates certain portions of the engine 36, such as, for example but without limitation, the pivotal joints of the connecting rod 58 with the crankshaft 56 and with the piston 48, the cam shaft 124, 126, the bearings journaling the crankshaft 56 within the crankcase and the walls of the cylinder bores 46.

A lubricant reservoir 199 is disposed at an appropriate location in the driveshaft housing 32. Lubricant in the reservoir is drawn therefrom by an lubricant pump 201, which can be driven by the crankshaft 56. However, the lubricant pump 201 may alternatively be driven by the driveshaft 200 or an electric motor. Lubricant from the lubricant pump 201 is directed to a lubricant supply line 203 and is delivered to various portions of the engine which benefit from circulating lubricant. After the lubricant has passed through the various engine galleries, the lubricant collects in an lubricant pan (not shown) provided at a lower end of the crank case. Lubricant returns to the lubricant pump 201 via a return line 205. Thus, the lubrication system 197 is formed as a closed loop.

The outboard motor 10 also includes a cooling system for cooling heated portions in the engine 36 such as the cylinder block 24 and a cylinder head assembly 55. In the illustrated embodiment, a water jacket 222 (FIG. 1) is provided in the cylinder block 44. A water pump (not shown) is provided for supplying cooling water to the various water jackets which may be included in the engine 36, including the water jacket 222. The water pump can be driven by the driveshaft 200. Although not shown, a water inlet is provided in the lower unit 34 to draw cooling water from the body of water surrounding the motor 36. The water is supplied to the water jackets through a water supply conduit 226.

As noted above, the engine control system controls various engine operations including firing of the spark plugs 174. The engine control system includes the ECU 110, various sensors and actuators. To appropriately control the engine 36, the engine control system utilizes maps and/or indices stored within the memory of the ECU 110 with reference to the data collected from various sensors. For example, the engine control system may refer to data collected from the throttle valve position sensor 108 and other sensors provided for sensing engine running conditions, ambient conditions or conditions of the outboard motor 10 that will affect engine performance.

Some of the more important sensors for the engine control system now will be described. It should be appreciated that it is practicable to provide other sensors, such as, for example, an intake air temperature sensor, an engine height sensor, a trim angle sensor, a knock sensor, a neutral sensor, a watercraft pitch sensor, a shift position sensor and an atmospheric temperature sensor in accordance with various control strategies.

As seen in FIG. 1, there is provided, associated with the crankshaft 56, a crankshaft angle position sensor 228. The crankshaft position sensor 228 defines a pulse generator that produces pulses as the crankshaft 56 rotates. The pulses are, in turn, converted to an engine speed within the ECU 110 or another separate converter (not shown) by measuring crankshaft angle versus time.

A water temperature sensor 232 is connected to the cylinder block 44 so as to communicate with the water jacket 222. The water temperature sensor 232 is configured to sense the temperature of water flowing through the water jacket 222 and to output a water temperature signal to the ECU 110 via a water temperature data line 234.

An intake air pressure sensor 236 is connected to one of the air intake passages 68. The air intake sensor 236 is configured to sense the pressure of the air in the intake passage 68 and to output a air pressure signal to the ECU 110 via a air pressure signal line 238.

Associated with either the intake or the exhaust camshaft 124, 126 is a cylinder discrimination sensor 240. In the illustrated embodiment, the cylinder discrimination sensor 240 is configured to sense the rotation of the exhaust camshaft 126. Accordingly, the cylinder discrimination sensor defines a pulse generator that produces pulses as the exhaust camshaft 126 rotates. The signal of the cylinder discrimination sensor 240 is transmitted to the ECU 110 via a signal line 242. As is well known in the art, the position of the pistons 48 with respect to the combustion cycle can be determined by comparing the pulse generated by the cylinder discrimination sensor 240 to the pulse generated by the crankshaft angle position sensor 228. In a preferred embodiment, the cylinder discrimination sensor 240 is arranged to sense a lobe positioned of one or more lobes of the exhaust camshaft 126.

The outboard motor 10 also preferably includes: a shift position sensor 244 that indicates the position of the shift rod 208, a lever speed sensor 244 that senses the rotational speed of the shift lever 88, and a watercraft velocity sensor 248 that is located at the lowermost portion of the transom 18 and senses the velocity of the watercraft 12.

Figure 4:
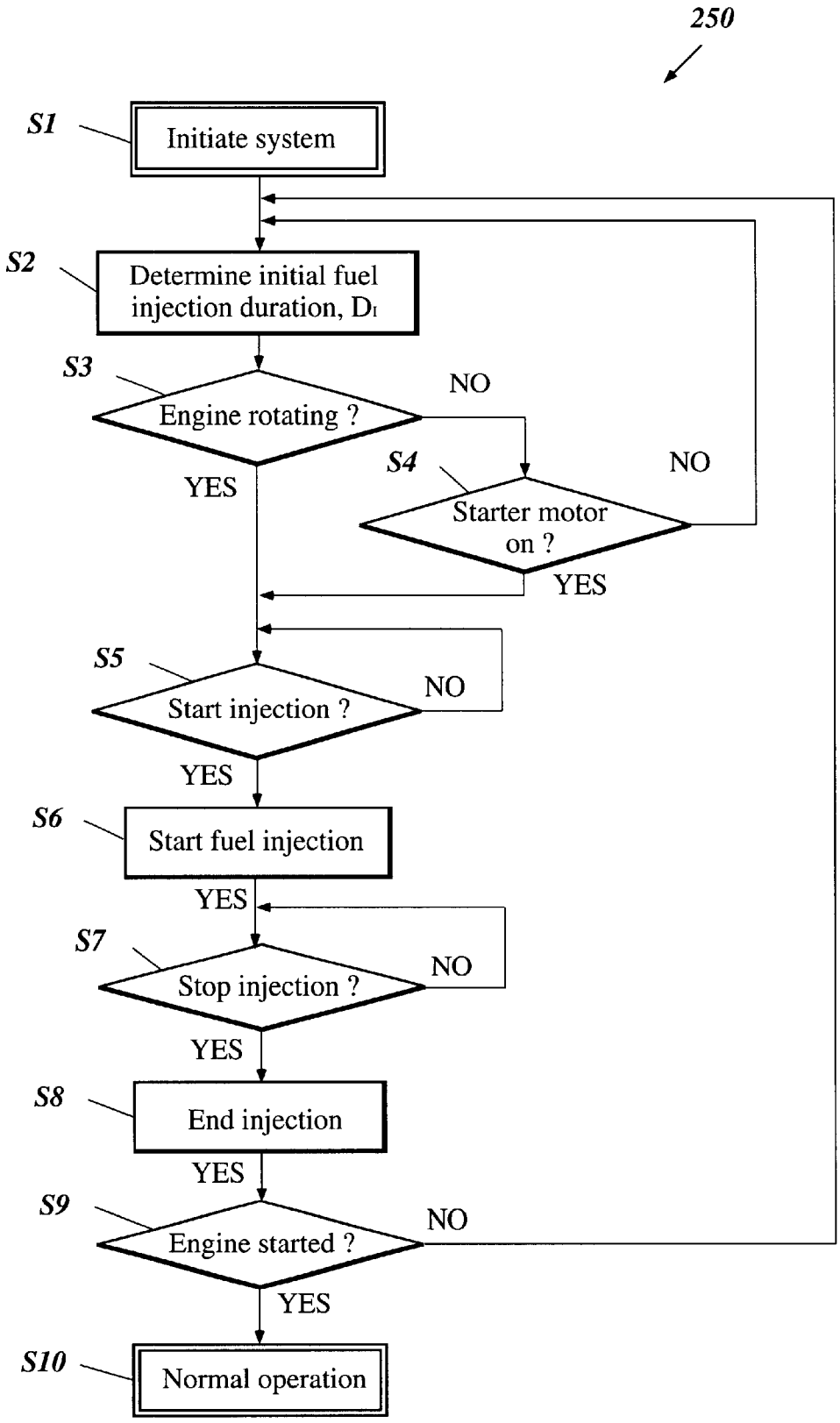
FIG. 4 is a flow diagram of a fuel injection control routine that can be with the ECU FIG. 1.
Figure 5:
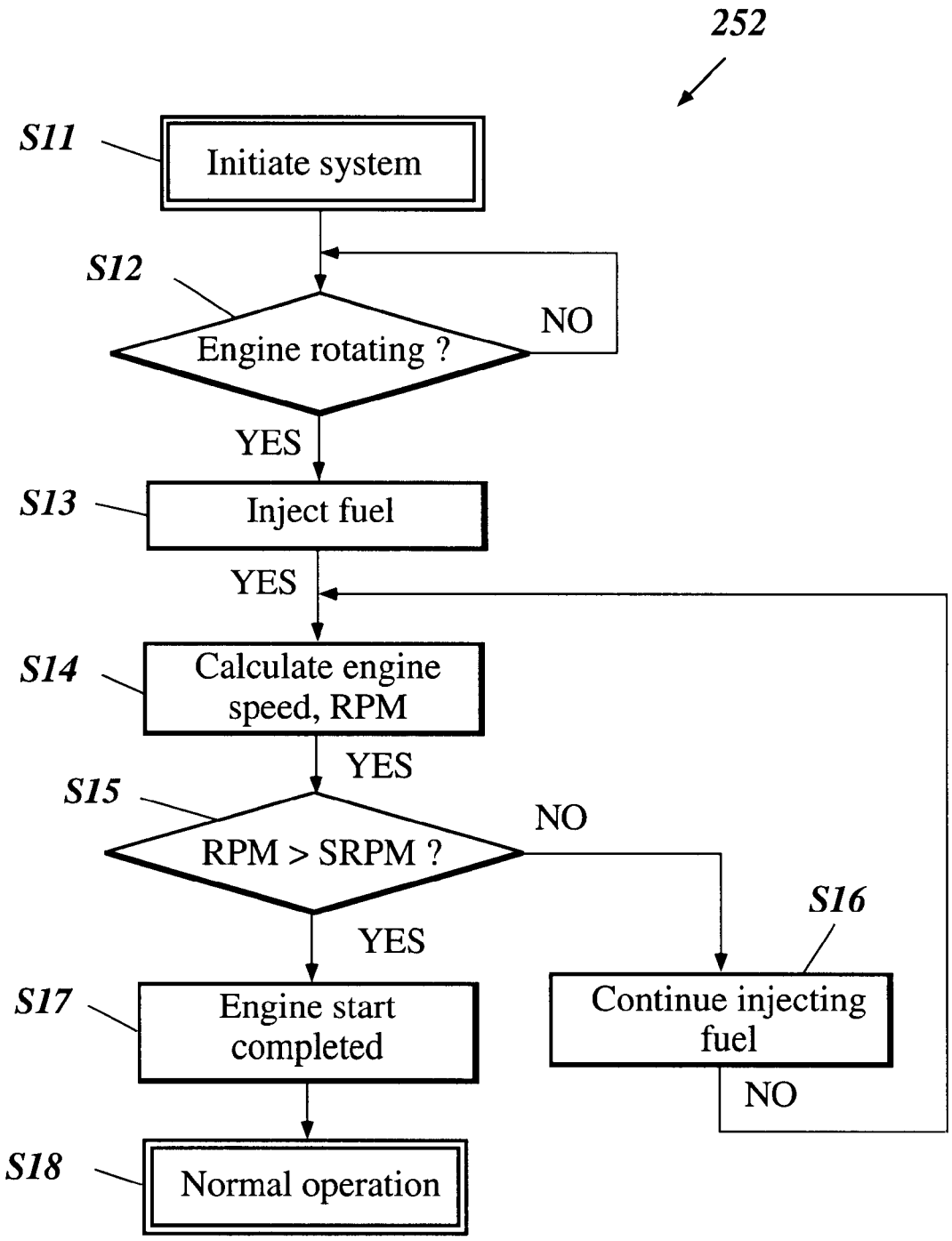
FIG. 5 is flow diagram of another fuel injection control routine that can be used in the ECU of FIG. 1.

With reference to FIGS. 1, 4 and 5, the operation and control of the fuel injection system 136 will now be described in detail. As noted above, the fuel injection system 136 includes four fuel injectors 138 with injection nozzles exposed that are exposed to the intake ports 70. The high pressure fuel pump 156, which is located within the vapor separator 150, delivers fuel to the fuel injectors 138 through a fuel delivery conduit 158. The fuel return conduit 164 returns excess fuel to the vapor separator 150. Because the fuel pressure is regulated by the pressure regulator 166, the duration during which the fuel injectors 136 is opened determines, for the most part, the amount of fuel delivered to the combustion chamber 52.

In the preferred embodiment, the fuel control system is a subsystem of the engine control system. Accordingly, the fuel control system shares several components with the engine control system, such as, for example, the ECU 110 and the intake air pressure sensor 232. However, the fuel control system could include separate components or be entirely separate from the engine control system. Preferably, the fuel system is a subsystem of the engine because this arrangement reduces number of parts and the cost of the outboard motor 10.

The fuel control system preferably includes a controller such as the ECU 110 that can receive data, perform steps and send commands. The fuel control system also includes several sensors such as the crankshaft angle position sensor 228 and the cylinder discrimination sensor 240. The fuel control system further includes an actuator such as the solenoids 170 for opening and closing the fuel injectors 138.

The fuel control system controls the timing and opening duration of the fuel injectors 136. The duration for which the nozzles of the fuel injectors 136 are opened per unit time is referred to as the duty ratio. During normal engine operations, the fuel control system determines the duty ratio in response to various engine running conditions. That is, to determine the desired duty ratio, the fuel control system compares data collected from various sensors to maps and/or indices stored within the memory of the ECU 110. For example, the duty ratio can be adjusted in response to the engine speed or throttle position. The engine speed and throttle position are determined by the signal sent by the crankshaft angle position sensor 228 and the throttle position sensor 108 respectively. The duty ratio may also adjusted in response to the intake air pressure and/or temperature. Such methods for controlling the duty ratio during normal engine operation are well known to those of ordinary skill in the art and a further discussion is not necessary to practice the invention.

A problem with prior fuel control systems is that when the engine is being started the engine speed cannot be determined until the engine completes one or more revolutions. Because fuel is typically injected in response to a measured engine speed, the fuel is not immediately delivered to the combustion chambers. This prevents the engine from starting immediately and requires the starter device (e.g., the starter motor or recoil starter) to turn the engine 36 longer. Determining the engine speed via the cylinder discrimination sensor 240 exacerbates the problem because the camshafts typically rotate at half the speed of the crankshaft.

FIG. 4 illustrates a control subroutine 250 that can be executed by the ECU 110 and enables the engine to start more quickly as compared to the prior fuel injection systems. As shown in FIG. 5 and represented by operational block S1, the fuel control system initializes. Preferably, the fuel control system initializes when an ignition starting device (e.g., a key activated switch) is activated.

As represented by operational block S2, the fuel control system once running determines the initial fuel injection duration $D_I$. The initial fuel injecting duration $D_I$ can be determined from a preset value that is stored within the ECU 110. The initial fuel injection duration $D_I$ also can be determined by collecting data from various sensors and comparing that data to a control maps and/or indices stored within the memory of the ECU 110. For example, data can be collected from the intake pressure sensor 236 or an ambient air temperature sensor (not shown). The fuel control system then can determine the initial fuel injection duration $D_I$ by referring to the control map and/or indices.

After the initial fuel injection duration $D_I$ has been determined, the fuel control system determines whether the engine 36 has begun rotating (as represented by decisional block S3). As mentioned above, the crankshaft angle position sensor 228 defines a pulse generator that produces pulses as the crankshaft 56 rotates. During normal engine operation, these pulses are converted within the ECU 110 (or by a converter) to an engine speed. However, the fuel control system determines that the engine 36 has begun rotating when it receives a pulse from the angle position sensor 228. In addition or in the alternative, the fuel control system can determine that the engine 36 has begun rotating by the signal generated by the cylinder discriminating sensor 240. However, the crankshaft angle position sensor 228 is preferred because the camshafts 124, 126 typically rotate at half the speed of the crankshaft 56.

As represented by decisional block S4, if the engine has not begun rotating the fuel control system determines whether the starter motor 171 has been turned on. If the starter motor 171 has not been turned on, the fuel control system loops back and either (i) re-determines the initial fuel injection duration D, (operational block S2), as illustrated in FIG. 4, or (ii) re-determines if the engine has begun rotating (decisional block S3). It should be appreciated that determining the initial fuel injection duration $D_I$ (operational block S2) can be performed after it has been determined whether the engine has begun rotating (decisional block S3) and/or the starter motor has turned on.

If (i) the starter motor 171 is turned on or (ii) the engine has begun rotating, the fuel system next determines if it is time to inject fuel into the engine 36, as represented by decisional block S5. As mentioned above, the position of each piston 48 with respect to the combustion cycle can be determined by comparing the pulses generated by crankshaft angle position sensor 228 and the cylinder discriminating sensor 240. For example, in a typical four-cycle, four cylinder engine that has a firing sequence of 1, 3, 4, 2, the first cylinder is 180 degrees out of phase with the third cylinder. Correspondingly, the fourth cinder is 180 degrees out of phase with the second cylinder. Meanwhile, the first and fourth cylinders and the second and third cylinders are 360 degrees out of phase with each other. Accordingly, the intake stroke of the first cylinder corresponds to the power stroke of the fourth cylinder. The pulse generated by the crankshaft position sensor 228 therefore cannot distinguish between the intake stroke and the power strokes of the first and fourth cylinders. In other words, the crankshaft position sensor 228 alone cannot determine whether the first cylinder is starting its intake stroke or its power stroke.

The cylinder discrimination sensor 240 can be used to distinguish the cylinders by providing an additional signal. For example, the signal from the cylinder discrimination sensor 240 can be set to indicate when either the first cylinder is starting its intake stroke. Correspondingly, when the fuel control system receives a signal from both the cylinder discrimination sensor 240 and the crankshaft position sensor 228, the fuel control system determines that the first cylinder is starting its intake stroke. If the firing sequence is 1, 3, 4, 2, it is also known that the forth cylinder is starting its power stroke. The positions of the second and third cylinders are also known. In a similar manner, when the fuel control system receives a signal only from the crankshaft position sensor 228, the fuel control system determines that the fourth cylinder is starting its intake stroke and that the first cylinder is starting its power stroke. The positions of the second and third cylinders are also known.

Accordingly, after the fuel control system receives signals from the crankshaft position sensor 228 and the cylinder discrimination sensor 240, the fuel system determines if it is time to inject fuel for either the first or the fourth cylinder or if it is time to inject fuel for the second and third cylinders. If it is time to inject the fuel, the fuel system injects fuel as indicated by operational step S6. Once injection begins, fuel is injected into each cylinder according to a preset injection sequence. If it is not time to inject the fuel for a specific (i.e., pre-selected) cylinder or for any cylinder, the fuel control system loops back until it is time to inject fuel into the engine.

As indicated by decisional block S7, the fuel control system determines if is time to stop injecting fuel in to the engine once injection has started. This can determined by comparing the initial fuel injection duration $D_I$ to the amount of time the fuel injectors 138 have been opened. If it is time to close the fuel injectors 138, the fuel control system closes the fuel injectors as indicated by operational block S8 If it is not time to close the fuel injectors 138, the fuel system loops back until it is time to stop fuel injection.

After fuel injection has stopped, the fuel control system determines if the engine 36 has started (decisional block S9). This can be determined by measuring the engine speed and comparing it to predetermined speed, as will be describe below. If the engine 36 has not started, the fuel control system loops back and re-determines the initial fuel injection duration $D_I$ (operational block S2). The fuel control system could alternatively loop back to determine if it is time to start injecting fuel (decisional block S5). If the engine 36 has started, the fuel control system returns to normal engine operating mode as is indicated by operational block S10.

As mentioned above, this fuel control system advantageously allows the engine to start more quickly under both manual and automatic start conditions. For example, under manual start conditions, the engine 36 begins rotating when the operator pulls on the recoil starter. The fuel control system then determines that the engine is rotating from the signal sent by the crank angle detection sensor 228. The fuel control system then injects fuel into the engine. Accordingly, fuel is injected into the engine without calculating the engine speed. This shortens the starting time of the engine.

Under automatic start conditions, the fuel injection system detects that starter motor 171 is turned (decisional block S4). Accordingly, the fuel control system injects fuel into the combustion chamber 52 as soon as the starter motor 171 rotates the engine.

Another advantage of the above-described fuel control system is that the same fuel control system can be used in outboard motors 10 with only recoil starters and outboard motors 10 with only automatic starters. This simplifies the manufacturing process.

FIG. 5 illustrates another subroutine 252 that can also be executed by the ECU 110 to start the engine 36. As with the first subroutine 250, the second routine 252 determines that the engine 36 has begun rotating by sensing the signal sent by the crankshaft position sensor 228 or by the cylinder discrimination sensor 240.

The fuel control system next determines if the engine 36 has begun rotating (decisional block S12). As with the previous embodiment, the fuel control systems determines that the engine 36 has begun rotating when it receives a pulse from the angle position sensor 228. In addition to or in the alternative, the fuel control system can determine that the engine 36 has begun rotating by the signal generated by the cylinder discriminating sensor 240. However, as explained above, the crankshaft angle position sensor 228 is preferred because the camshafts 124, 126 typically rotate at half the speed of the crankshaft 56. If the engine 36 has not begun rotating, the fuel control system loops back until the engine 36 begins rotating.

As shown in FIG. 5, the fuel control system first initializes (operational step S11). As mentioned above, the fuel control system can only initialize when an ignition starting device is activated (e.g., a key activated switch).

The fuel control system next determines if the engine 36 has begun rotating (decisional block S2). As with the previous embodiment, the fuel control systems determines that the engine 36 has begun rotating when it receives a pulse from the angle position sensor 228. In addition to or in the alternative, the fuel control system can determine that the engine 36 has begun rotating by the signal generated by the cylinder discriminating sensor 240. However, as explained above, the crankshaft angle position sensor 228 is preferred because the camshafts 124, 126 typically rotate at half the speed of the crankshaft 56. If the engine 36 has not begun rotating, the fuel control system loops back until the engine 36 begins rotating.

After the engine begins rotating, the fuel control system begins injecting fuel into the combustion chamber 52 as indicated by operational block S13. Operation block S13 preferably includes the same steps described in connection with the first routine. For example, the fuel control system determines the initial fuel injection duration $D_I$ from either a preset value that is stored within the ECU 110 or from collected data from various sensors and a control maps and/or indices stored within the ECU 110. The fuel injection system also determines if it is time to start fuel injection by comparing the signals received from the cylinder discriminating sensor 240 and the crankshaft angle position sensor 228.

After fuel is injected into the engine 36, the fuel control system calculates the engine speed RPM from the pulses received from the crankshaft position sensor 228 or the cylinder discriminating sensor 240 (operational block S14). The fuel injection system then determines if the sensed engine speed RPM is greater than a started engine speed SRPM (started revolutions per minute), as indicated by decisional block S5. The started engine speed SRPM is typically less than the idling speed of the engine 36. If the sensed engine speed RPM is less than the started engine speed SRPM, the fuel control system continues to inject fuel in to the engine 36 preferable at a rich fuel/air ratio (operational block S16).

It should be appreciated that the started engine speed SRPM can be based upon a preset value, which is stored in the memory of the ECU 110. Alternatively, the started engine speed SRPM can be determined from data collected from various sensors that has been compared to a control map and/or indices.

If the sensed engine speed SRPM is greater than the started engine speed SRPM, the fuel control system completes the starting operations (operational block S17). At this point, the fuel control system can turn off the starter motor and/or turn off indicator lights that indicated the engine 36 is starting. The fuel control system resumes normal operations at this point of the control routine (operational block S18).

Under manual start conditions, the engine 36 begins rotating when the operator pulls on the recoil starter. The fuel control system determines that the engine 36 is rotating from the signal sent by the crank angle detection sensor 228. The fuel control system then injects fuel into the engine. Accordingly, fuel is injected into the engine 36 without calculating the engine speed. This shortens the starting time of the engine.

Under automatic starting conditions, the engine 36 begins rotating when the starter motor 171 is turned on. The fuel control system determines that the engine 36 is rotating from the signal sent by the crank angle detection sensor 228. The fuel control system then injects fuel into the engine. Accordingly, fuel is injected into the engine 36 without calculating the engine speed, which shortens the starting time of the engine.

Figure 6:
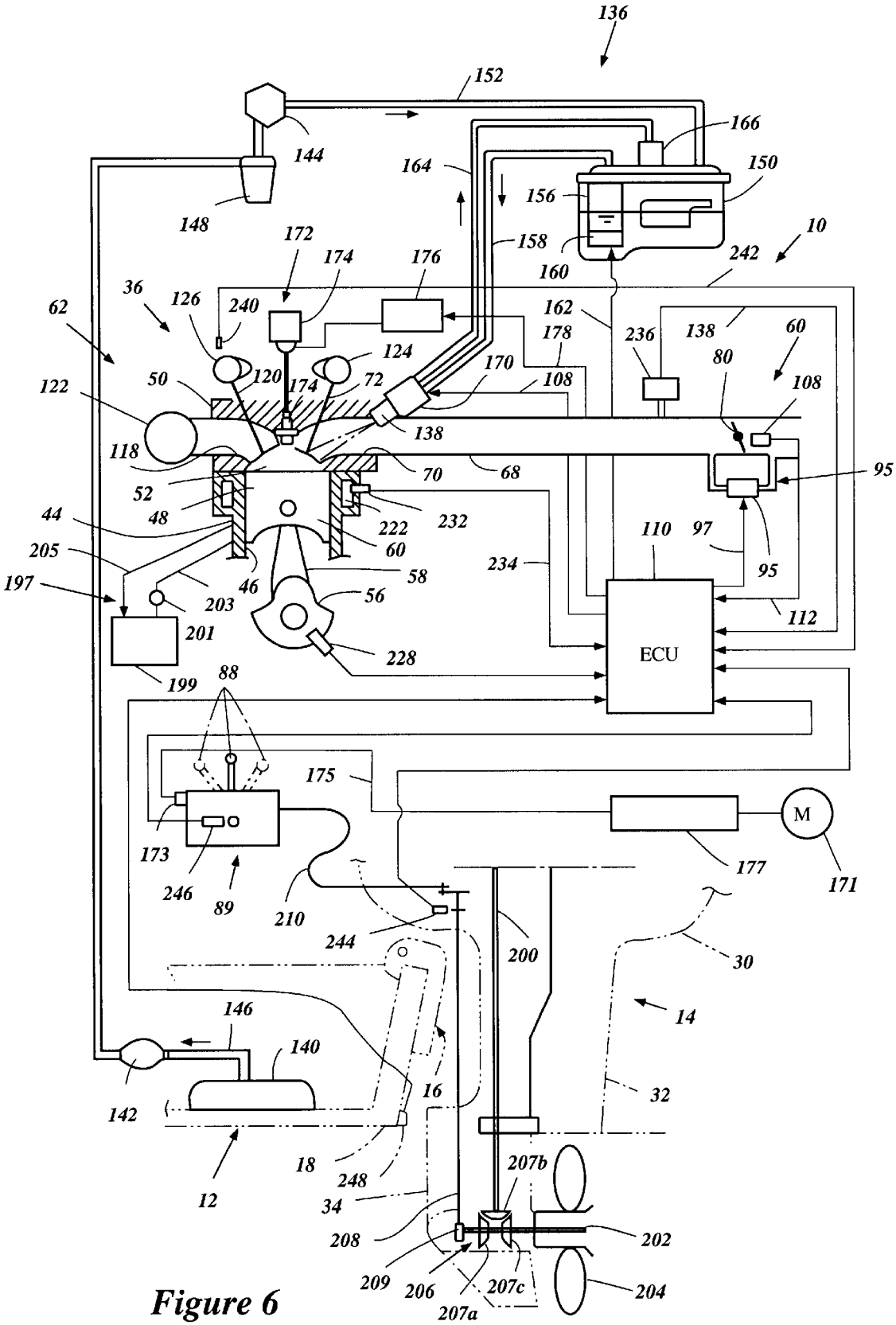
FIG. 6 is a schematic view showing an outboard motor in accordance with another embodiment of the present invention. An engine, in part, and an ECU are shown generally in the upper half of the figure. The outboard motor, in part, with a transmission, a shift device of the transmission and an associated watercraft are shown in the lower half of the figure. The ECU and a fuel supply line link the two views together. The outboard motor and associated watercraft are illustrated in phantom.

The fuel control system also determines that the engine has completed starting by measuring the engine speed. Once the engine speed reaches a specific value, the fuel control system determines that the engine 36 has started. Until the then, the fuel control system continues to inject fuel at a rich fuel/air ratio. Importantly, this embodiment of the fuel control system does not require that the signal line 175 be connected to the ECU 110 (see FIG. 6).

It is to be noted that the ECU 110 utilized by the above described fuel control systems may be in the form of a hard wired feed back control circuit that perform the functions of the subroutines 250, 252 described above. Alternatively, the ECU may be constructed of dedicated processor and a memory for storing a computer program configured to perform the steps S1–S10 of subroutine 250 and the steps S11–S18 of subroutine 252. Additionally, the ECU may a general purpose computer having a general purpose processor and the memory for storing a computer program for performing the subroutines 250, 252.

Of course, the foregoing description is that of certain features, aspects and advantages of the present invention to which various changes and modifications may be made without departing from the spirit and scope of the present invention. Moreover, a watercraft may not feature all objects and advantages discussed above to use certain features, aspects and advantages of the present invention. Thus, for example, those skilled in the art will recognize that the invention may be embodied or carried out in a manner that achieves or optimizes one advantage or group of advantages as taught herein without necessarily achieving other objects or advantages as may be taught or suggested herein. Moreover, many of the steps of the routines described above can be performed in various orders, as will be well understood by one skilled in the art from the above description, while still carrying out one or more objects or advantages of the present invention. The present invention, therefore, should only be defined by the appended claims.

What is claimed is:

1. An internal combustion engine comprising at least one combustion chamber formed by at least a first member and a second member that moves relative to the first member, the second member being coupled to an output shaft such that movement of the second member causes the output shaft to rotate, a fuel injector supplying fuel to the combustion chamber, the fuel injector including an actuator to regulate an amount of fuel injected by the fuel injector, a valve mechanism configured to regulate fluid flow into and out of the combustion chamber, the valve mechanism including at least one camshaft coupled to the output shaft and arranged to actuate at least some valves of the valve mechanism, and a fuel control system including a controller, which is connected to the fuel injector actuator, a first sensor, which is arranged to detect rotation of the output shaft, and a second sensor connected to the controller and positioned to sense rotation of the camshaft, the first sensor being adapted to produce a first signal that is indicative of rotation of the output shaft and being connected to the controller, the second sensor being adapted to produce a second signal at the beginning of an intake stroke of the second member, the controller being configured to output a control signal to actuate the fuel injector actuator when the first signal is received from the first sensor indicating that the output shaft has initially begun to rotate and when the second signal is received from the second sensor indicating that the second member is starting an intake stroke.

2. An internal combustion engine as set forth in claim 1, wherein the second sensor is arranged to sense a lobe position of one or more lobes of the camshaft.

3. An internal combustion engine as set forth in claim 1, additionally comprising a plurality of combustion chambers, and the controller being configured to determine a particular stroke associated with each combustion chamber of the engine from the first and second signals of the first and second sensors.

4. An internal combustion engine as set forth in claim 1, wherein the first sensor is positioned to sense rotation of the output shaft.

5. An internal combustion engine as set forth in claim 1, wherein the controller is configured to determine that the engine has started by calculating an engine speed from the first signal of the first sensor and comparing it to a predetermined engine start speed.

6. An internal combustion engine as set forth in claim 1 additionally comprising an air induction system delivering an air charge to the combustion chamber, and the fuel injector is arranged to spray the fuel into the air induction system.

7. An internal combustion engine as set forth in claim 1 in combination with a marine propulsion device, wherein the engine powers the marine propulsion device.

8. An internal combustion engine as set forth in claim 7, wherein the marine propulsion device is an outboard motor and the engine is enclosed in a cowling of the outboard motor.

9. An internal combustion engine comprising at least one combustion chamber, formed by at least a first member and a second member that moves relative to the first member through at least and intake stroke and an exhaust stroke, the second member being coupled to an output shaft such that movement of the second member causes the output shaft to rotate, a fuel injector supplying fuel to the combustion chamber, means for generating a signal at the beginning of the second member's intake stroke, and controlling means for starting the injection of fuel into the combustion chamber after the output shaft initially begins rotating and as the second member's intake stroke begins as the engine is started such that fuel injection is always started within one rotation of the output shaft.

10. A fuel injection system as set forth in claim 9 additionally comprising means for determining when the engine has started.

11. An internal combustion engine as set forth in claim 9 in combination with a marine propulsion device, wherein the engine powers the marine propulsion device.

12. An internal combustion engine as set forth in claim 11, wherein the marine propulsion device is an outboard motor and the engine is enclosed in a cowling of the outboard motor.

13. A fuel injection system as set forth in claim 12, wherein the engine comprises a valve mechanism to regulate fluid flow into and out of the combustion chamber.

14. An internal combustion engine as in claim 9, wherein the second member is also configured to move through at least a power stroke and a compression stroke.

15. An internal combustion engine as in claim 9, wherein during at least a portion of the intake stroke an intake charge is compressed.

16. An internal combustion engine comprising at least one combustion chamber formed by at least a first member and a second member that moves relative to the first member, the second member being coupled to an output shaft such that movement of the second member causes the output shaft to rotate, a fuel injector supplying fuel to the combustion chamber, the fuel injector including an actuator to regulate an amount of fuel injected by the fuel injector, and a fuel control system including a controller, which is connected to the fuel injector actuator, and a sensor, which is arranged to detect rotation of the output shaft, the sensor being adapted to produce a signal that is indicative of rotation of the output shaft and being connected to the controller, the controller being configured to receive a signal from an electric starter motor as an indication of starting of the engine, the controller being configured to operate at least under an engine start routine and a normal operation routine, said controller further configured to determine when to continue operating under the engine start routine by determining if the engine is operating above an engine start speed, the controller being further configured to determine when the engine is being started when an electric starter motor is not installed on the engine.

17. An internal combustion engine as set forth in claim 16, wherein the engine includes a valve mechanism to regulate fluid flow into and out of the combustion chamber, and the valve mechanism includes at least one camshaft arranged to actuate at least some valves of the valve mechanism and coupled to the output shaft.

18. An internal combustion engine as set forth in claim 17, wherein the sensor is positioned to sense rotation of the camshaft.

19. An internal combustion engine as set forth in claim 16, wherein the output shaft is a crankshaft and the sensor is positioned to sense rotation of the output shaft.

20. An internal combustion engine as set forth in claim 16 additionally comprising an air induction system delivering an air charge to the combustion chamber, and the fuel injector is arranged to spray the fuel into the air induction system.

21. An internal combustion engine as set forth in claim 16 in combination with a marine propulsion device, wherein the engine powers the marine propulsion device.

22. An internal combustion engine as set forth in claim 21, wherein the marine propulsion device is an outboard motor and the engine is enclosed in a cowling of the outboard motor.

23. A method of starting an internal combustion engine including at least one a combustion chamber, a piston, a crankshaft, at least one camshaft, and at least one fuel injector, the method comprising moving the piston through at least an intake stroke and an exhaust stroke, generating a signal at the beginning of the intake stroke, sensing the rotation of either the crankshaft or the camshaft, determining an amount of fuel to be injected by the fuel injector toward the combustion chamber, and injecting the amount of fuel into the combustion chamber in response to the sensed rotation of either the crankshaft or the camshaft when the respective shaft initially begins to rotate and the piston begins the intake stroke as the engine is starting.

24. A method of operating an internal combustion engine as set forth in claim 23 further comprising determining that the engine has started by calculating an engine speed and comparing the calculated engine speed to a predetermined starting engine speed.

25. A method of operating an internal combustion engine as in claim 23, further comprising moving the piston through at least a power stroke and a compression stroke.

26. A method of operating an internal combustion engine as in claim 23, wherein moving the piston through the intake stroke comprises compressing an intake charge through at least a portion of the intake stroke.

* * * * *